US009642455B1

(12) United States Patent
Albert

(10) Patent No.: US 9,642,455 B1
(45) Date of Patent: May 9, 2017

(54) OVERBED CADDY CART

(71) Applicant: Sherry Albert, Danvers, MA (US)

(72) Inventor: Sherry Albert, Danvers, MA (US)

( * ) Notice: Subject to any disclaimer, the term of this patent is extended or adjusted under 35 U.S.C. 154(b) by 0 days.

(21) Appl. No.: 15/340,212

(22) Filed: Nov. 1, 2016

(51) Int. Cl.

| | |
|---|---|
| ***A47B 85/00*** | (2006.01) |
| ***A47B 23/04*** | (2006.01) |
| ***A47B 31/00*** | (2006.01) |
| ***A47B 9/14*** | (2006.01) |
| ***A47B 9/20*** | (2006.01) |
| ***A47B 21/06*** | (2006.01) |
| ***A47B 1/05*** | (2006.01) |
| ***A47B 23/06*** | (2006.01) |
| ***F21V 23/04*** | (2006.01) |
| ***F21V 33/00*** | (2006.01) |
| ***F21V 23/00*** | (2015.01) |

(52) U.S. Cl.

CPC ..... *A47B 23/046* (2013.01); *A47B 1/05* (2013.01); *A47B 9/14* (2013.01); *A47B 9/20* (2013.01); *A47B 21/06* (2013.01); *A47B 23/06* (2013.01); *A47B 31/00* (2013.01); *F21V 23/001* (2013.01); *F21V 23/04* (2013.01); *F21V 33/0012* (2013.01); *A47B 2021/066* (2013.01); *A47B 2031/003* (2013.01)

(58) Field of Classification Search

CPC ..... A47B 2220/0077; A47B 2220/00; A47B 23/00; A47B 21/008; A47B 21/00; A47B 21/007; A47B 21/0314; A47B 45/00; A47B 87/0207

USPC ..... 108/23, 49, 50.01, 50.02, 90, 92; 312/223.3, 223.5

See application file for complete search history.

(56) References Cited

U.S. PATENT DOCUMENTS

| | | | | |
|---|---|---|---|---|
| 3,910,659 | A * | 10/1975 | Peterson | A47B 23/046 297/174 R |
| 5,116,264 | A * | 5/1992 | Wiederrich | B25H 5/00 108/23 |
| 5,829,501 | A * | 11/1998 | DeVito | B25H 1/02 108/162 |
| 5,842,238 | A * | 12/1998 | Herrick | A45D 19/04 4/516 |
| 6,269,753 | B1 * | 8/2001 | Roddan | A47B 21/00 108/50.01 |
| 6,493,220 | B1 * | 12/2002 | Clark | A47B 21/00 248/918 |

(Continued)

FOREIGN PATENT DOCUMENTS

WO 2009152429 A1 12/2009

*Primary Examiner* — Jose V Chen
(74) *Attorney, Agent, or Firm* — Kyle A. Fletcher, Esq.

(57) ABSTRACT

The over bed caddy is a transportable table that is adapted for use with a person. The over bed caddy is adapted for use with a person in a reclined or upright position. The over bed caddy provides one or more horizontal surfaces for use by the person in the reclined position on a reclining surface. The over bed caddy is adjustable in height. The over bed caddy is mounted on a rolling frame. The over bed caddy provides lighting and electric power for use at the one or more horizontal surfaces. The over bed caddy comprises a tray assembly, a personal storage unit, a telescopic stanchion, and an H assembly. The H assembly is attached to the telescopic stanchion, which is attached to the tray assembly. The personal storage unit is adapted to receive domestic items and devices.

13 Claims, 6 Drawing Sheets

(56) References Cited

U.S. PATENT DOCUMENTS

| | | | | |
|---|---|---|---|---|
| 6,543,369 | B1 * | 4/2003 | Swensson | A47B 23/046 108/103 |
| 7,111,852 | B2 * | 9/2006 | Woods | B62B 3/00 280/47.34 |
| D588,829 | S * | 3/2009 | Rheault | D6/406.1 |
| 7,540,243 | B2 | 6/2009 | George | |
| 7,967,137 | B2 | 6/2011 | Fulbrook | |
| 8,082,857 | B2 * | 12/2011 | George | A61B 5/0002 108/49 |
| D654,294 | S * | 2/2012 | Davis | D6/705 |
| 8,276,523 | B2 * | 10/2012 | Miller | A47B 21/00 108/50.02 |
| 8,485,111 | B2 * | 7/2013 | Chinuki | A47B 13/10 108/50.01 |
| 8,662,605 | B2 * | 3/2014 | McRorie | B62B 3/02 108/38 |
| 8,677,528 | B2 | 3/2014 | Hookway | |
| 9,139,213 | B2 * | 9/2015 | Trish | A61G 12/001 |
| 9,271,569 | B2 * | 3/2016 | Zaccai | A47B 83/045 |
| 9,472,966 | B2 * | 10/2016 | Frushour | A61B 50/13 |
| 2009/0266274 | A1 | 10/2009 | Berlin | |
| 2009/0319079 | A1 * | 12/2009 | Arceta | A61G 12/001 700/228 |
| 2011/0232535 | A1 * | 9/2011 | Hung | A61G 12/001 108/25 |
| 2011/0272901 | A1 * | 11/2011 | Inderbitzin | A61G 12/001 280/29 |
| 2012/0312196 | A1 | 12/2012 | Newkirk | |
| 2014/0331901 | A1 * | 11/2014 | Seefeldt | A47B 21/06 108/50.02 |

* cited by examiner

OVERBED CADDY CART

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of tables or desks adapted for specific purposes, more specifically, a bedside or chair table supported from the floor.

SUMMARY OF INVENTION

The over bed caddy is a transportable table that is adapted for use with a person. The over bed caddy is adapted for use with a person in a reclined or an upright position on a reclining surface. The over bed caddy provides one or more horizontal surfaces for use by the person in the reclined or upright position. The over bed caddy is adjustable in height. The over bed caddy is mounted on a rolling frame. The over bed caddy provides lighting and electric power for use at the one or more horizontal surfaces. The over bed caddy provides storage for personal items and devices, and is optionally locked.

These together with additional objects, features and advantages of the over bed caddy will be readily apparent to those of ordinary skill in the art upon reading the following detailed description of the presently preferred, but nonetheless illustrative, embodiments when taken in conjunction with the accompanying drawings.

In this respect, before explaining the current embodiments of the over bed caddy in detail, it is to be understood that the over bed caddy is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the over bed caddy.

It is therefore important that the claims be regarded as including such equivalent construction insofar as they do not depart from the spirit and scope of the over bed caddy. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
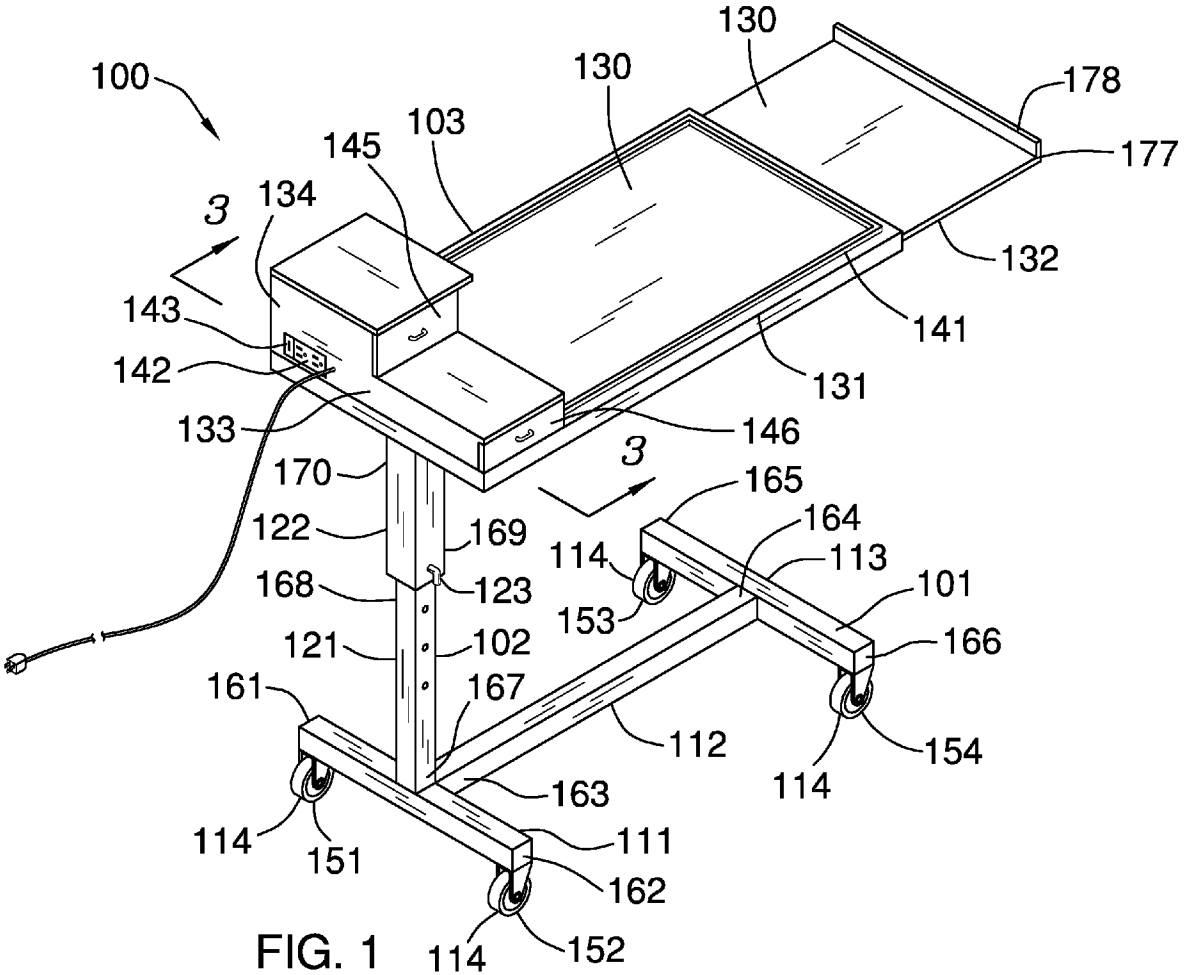
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The over bed caddy 100 (hereinafter invention) comprises a tray assembly 103, a telescopic stanchion 102, and an H assembly 101. The H assembly 101 is attached to the telescopic stanchion 102, which supports the tray assembly 103. The invention 100 is a transportable table that is adapted for use with a person. The invention 100 is adapted for use with a reclining surface 181 within which a person may rest in a reclined or upright position. The invention 100 is adapted for use in storing domestic articles. The invention 100 is adapted for use with electrically powered devices. The invention is adapted for use on a supporting surface 183 such as a floor. The invention 100 provides one or more horizontal surfaces 130 for use from the reclining surface 181. The invention 100 is adjustable in height. The invention 100 is mounted on a rolling frame. The invention 100 provides lighting and electric power for use at the one or more horizontal surfaces 130.

The tray assembly 103 comprises the one or more horizontal surfaces 130, an electrical housing 133, and a personal housing 134. The electrical housing 133 is mounted on the one or more horizontal surfaces 130. The personal housing 134 is mounted on the electrical housing 133 in a position that is distal from the one or more horizontal surfaces 130. The personal housing 134 is adapted to receive personal items or devices, and may optionally be equipped with a lock in order to provide secure storage. The one or more horizontal surfaces 130 further comprise a primary surface 131 and a nested surface 132. The nested surface 132 is primarily contained within the primary surface 131. The nested surface 132 is further defined with a distal edge 177 that includes a lip 178 that extends vertically.

The primary surface 131 is a first rectangular plate that forms a flat horizontal surface while the invention 100 is in use. The primary surface 131 comprises a channel 140 and a lip 141. The lip 141 is a rim that forms the perimeter of a contained space on the surface of the primary surface 131 that is distal from the reclining surface 181. The purpose of the lip 141 is to contain spilled liquids within the perimeter of lip 141 such that the spilled liquid will not fall upon the resting surface 181. The channel 140 is a negative space that forms a cavity within the first rectangular plate of the primary surface 131. The nested surface 132 is a second rectangular plate that forms an extended, flat horizontal surface while the invention 100 is in use. The inner dimensions of the channel 140 is greater than the outer dimensions of the nested surface 132. The nested surface 132 is sized such that the nested surface 132 will slide into the channel 140 such that the nested surface 132 is stored within the primary surface 131 in a nested fashion. The nested surface 132 is withdrawn from the channel 140 for use as an additional surface area. While extended, the nested surface 132 is supported via the portion of the nested surface 132 that remains within the channel 140.

As shown most clearly in FIG. 1, the electrical housing 133 is a cabinet that is mounted on the surface of the primary surface 131 that is distal from the reclining surface 181. Purpose of the electrical housing 133 is to draw electrical power from the national electric grid 182 and convert and transfer this power into forms that can be used to power personal data devices and other electrically powered devices. The electrical housing 133 comprises an AC/DC converter 147, one or more NEMA 5-15 electrical sockets 142, and one or more USB ports 143. As shown most clearly in FIG. 6, each of the one or more NEMA 5-15 electrical sockets 142 are directly connected to the national electric grid 182. Each of the one or more USB ports 143 are connected to the AC/DC converter 147. The AC/DC converter 147 is connected to the national electric grid 182 such that the AC/DC converter 147 will convert the electric power received from the national electric grid 182 in to power that can be consumed by devices that use the USB protocols.

Figure 2:
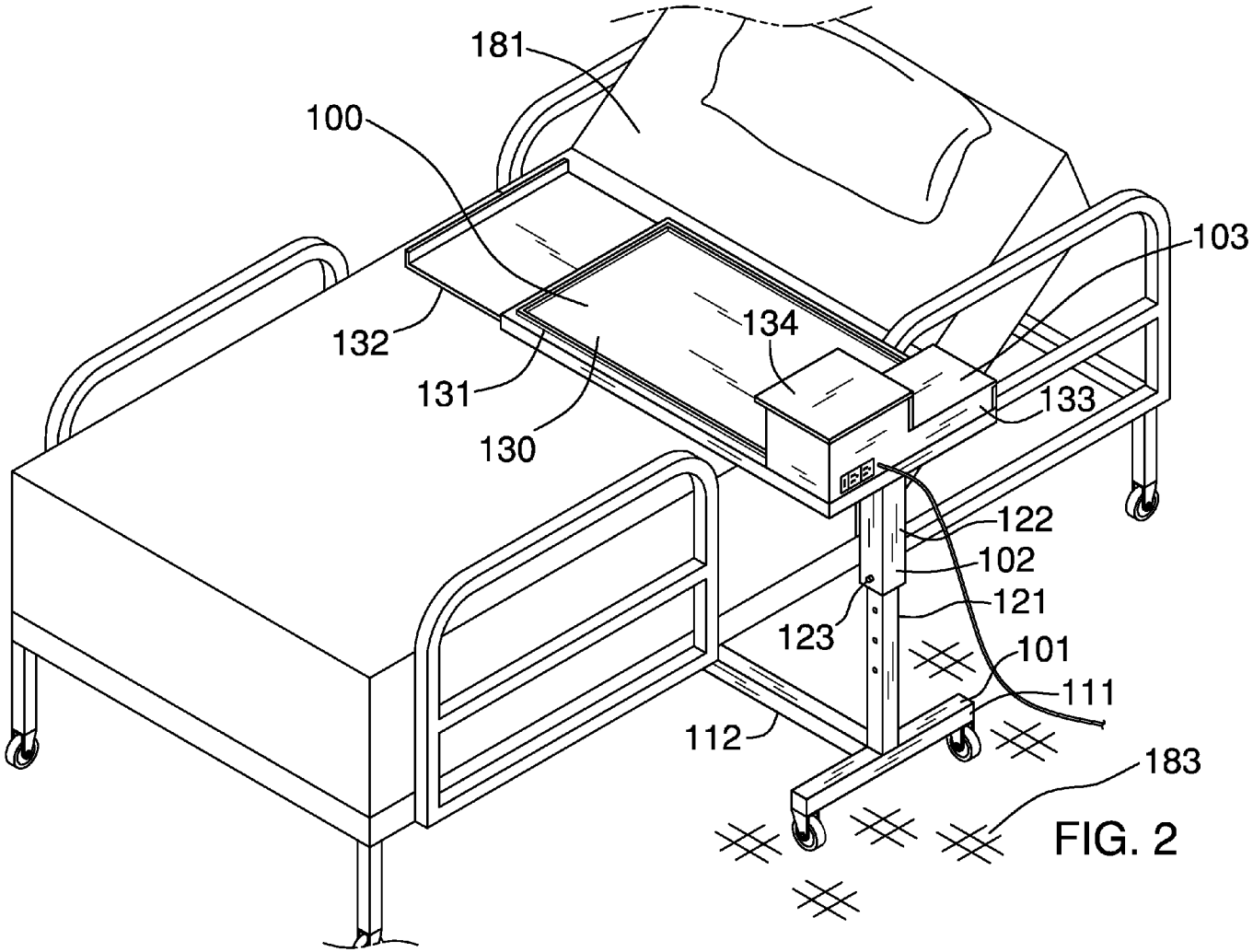
FIG. 2 is an in use view of an embodiment of the disclosure.
Figure 3:
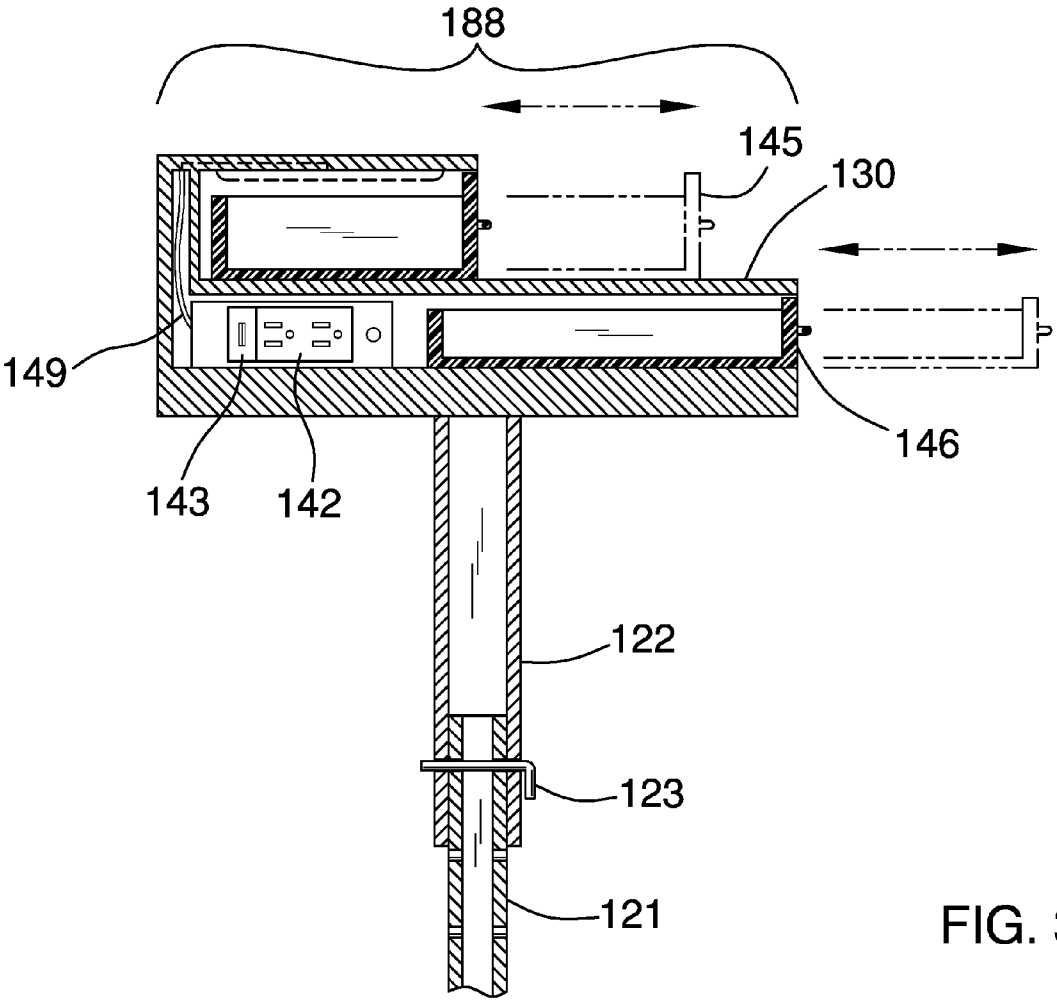
FIG. 3 is a cross-sectional view of an embodiment of the disclosure across 3-3 as shown in FIG. 1.
Figure 4:
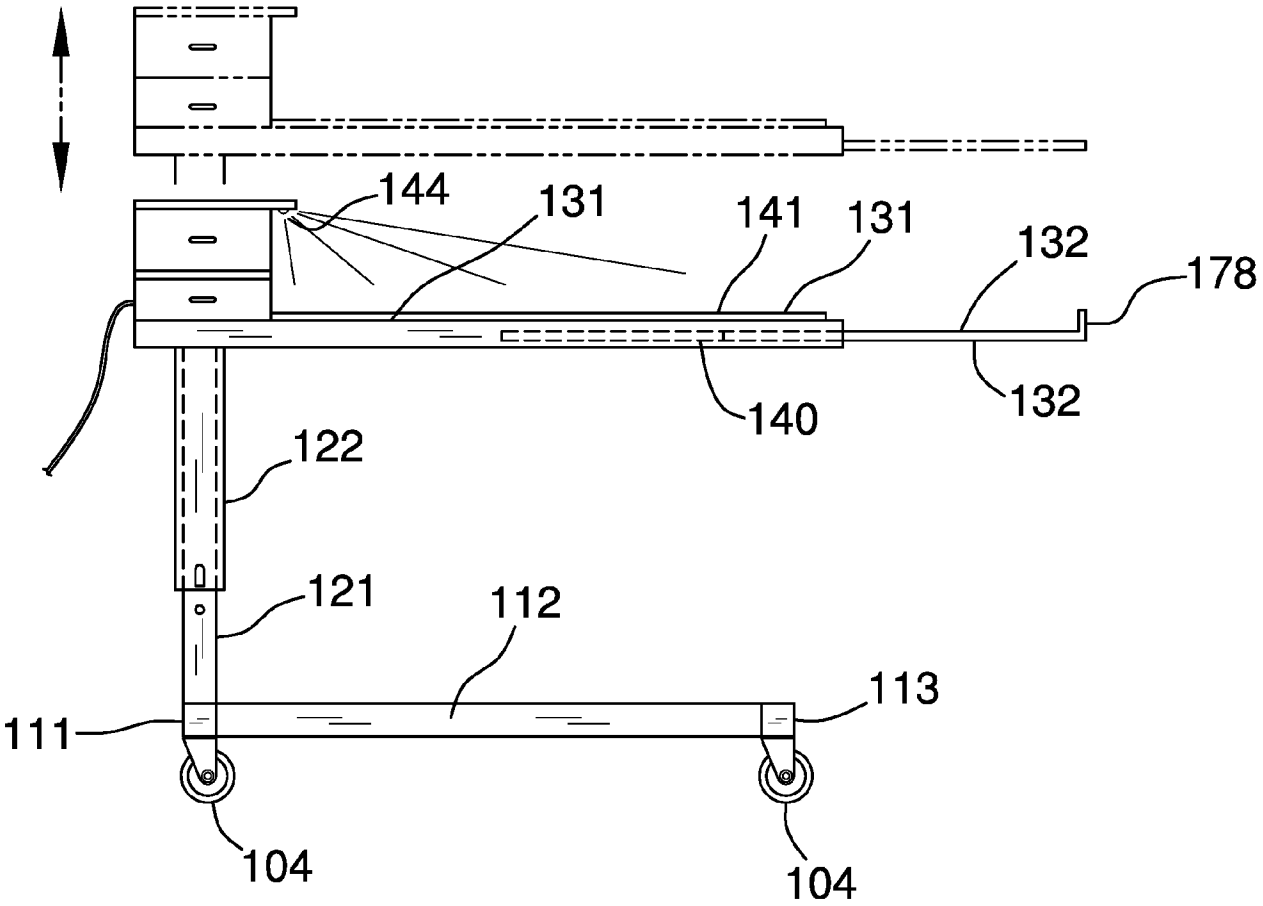
FIG. 4 is a front view of an embodiment of the disclosure.
Figure 5:
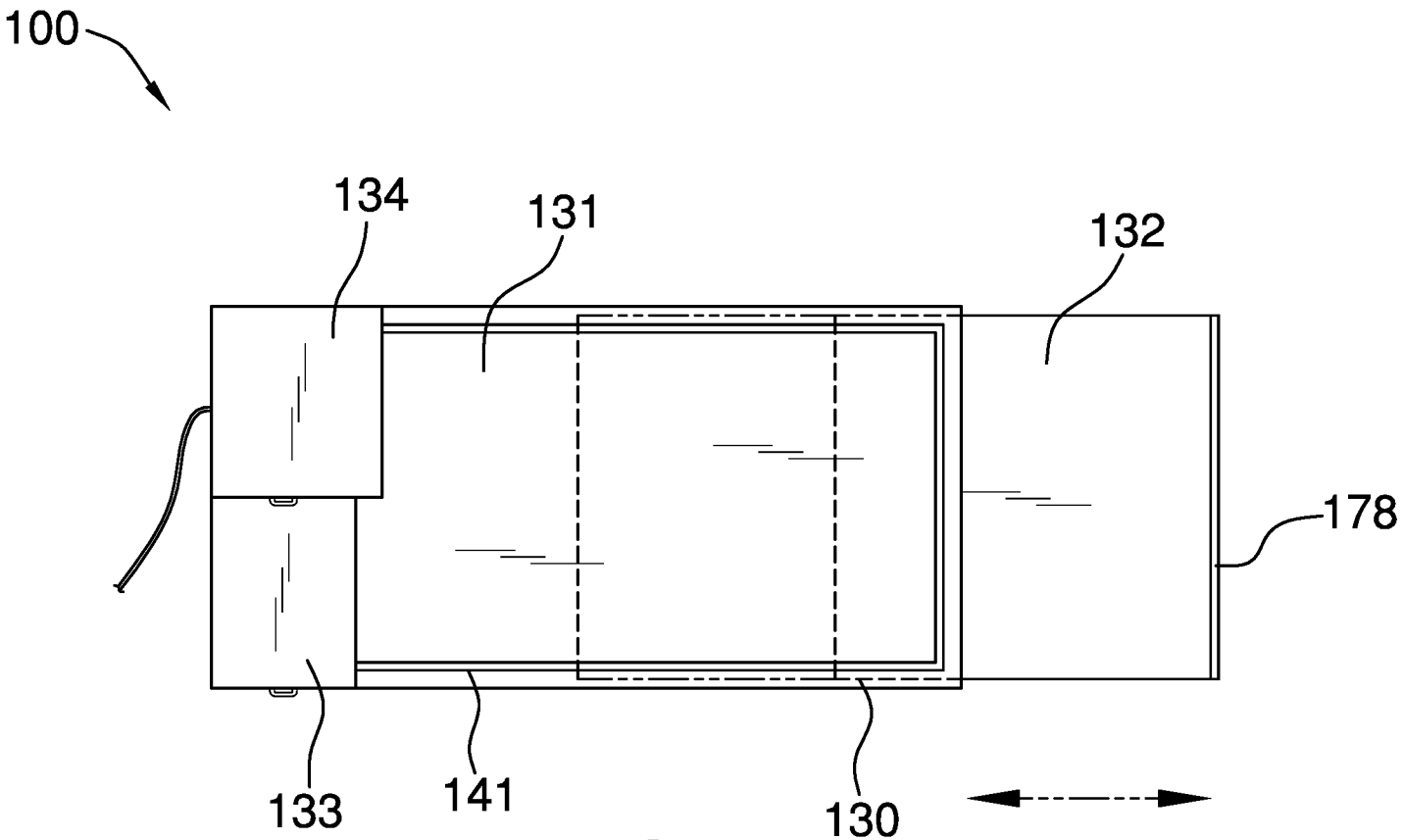
FIG. 5 is a top view of an embodiment of the disclosure.
Figure 6:
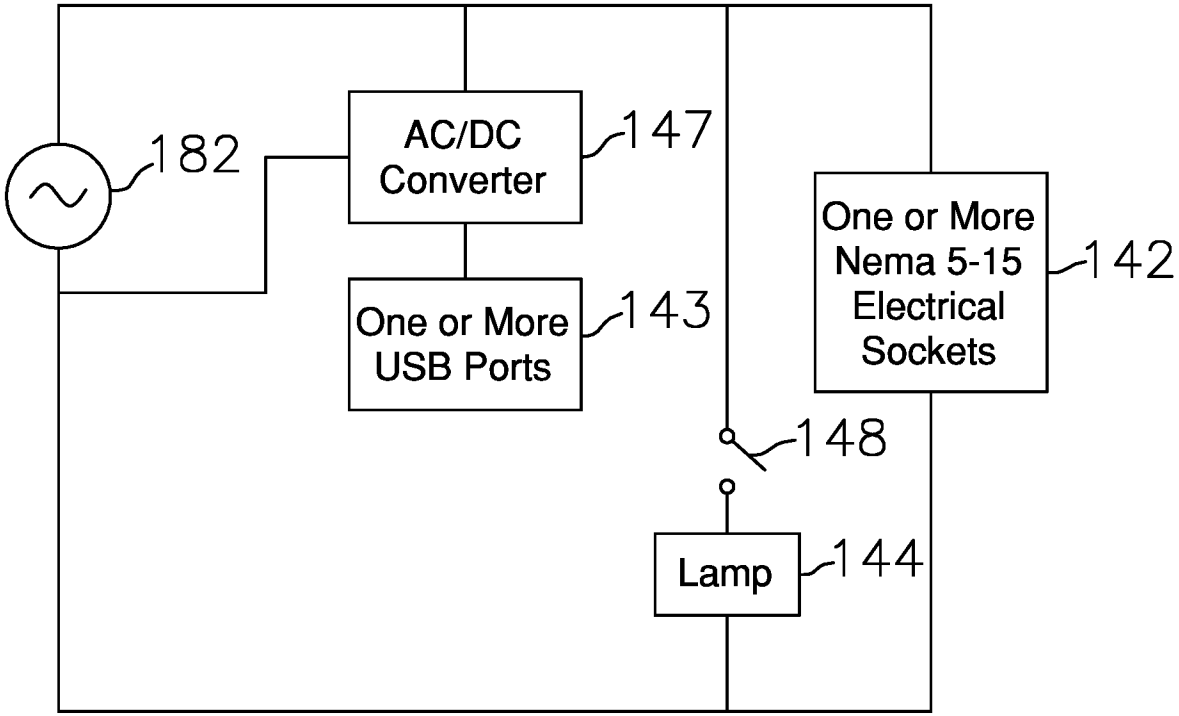
FIG. 6 is an electric schematic of an embodiment of the disclosure.

As shown most clearly in FIGS. 1 and 2, the one or more NEMA 5-15 electrical sockets 142, and the one or more USB ports 143 are mounted on the electrical housing 133 such that the each of the one or more NEMA 5-15 electrical sockets 142, and the one or more USB ports 143 are accessible externally from the electrical housing 133. Methods to implement the circuits described in this paragraph are well known and documented within the electrical arts.

As shown most clearly in FIG. 1, the personal housing 134 is a cabinet within which the domestic articles or devices may be stored. The personal housing 134 comprises a first drawer 145 and a second drawer 146 within which the domestic articles may be stored. Methods to form drawers in cabinets and dividers are well known in the carpentry arts. The first drawer 145 is positioned adjacent to and optionally above the second drawer 146. Moreover, the second drawer 146 extends outwardly with respect to the first drawer 145 such that the first drawer 145 and the second drawer 146 form a step 188.

The personal housing 134 further comprises a lamp 144. The lamp 144 is a light that illuminates the primary surface 131 and the nested surface 132 of the invention 100. As shown most clearly in FIGS. 3 and 6, the lamp 144 is connected via a cable 149 that transfers power from the national electric grid 182. The lamp 144 is controlled through the use of a switch 148 that is placed in series between the national electric grid 182 and the lamp 144. Methods to implement the circuit described in this paragraph are well known and documented within the electrical arts.

The telescopic stanchion 102 is an adjustable stanchion that: 1) is used to attach the tray assembly 103 to the H assembly 101; and, 2) adjusts the span of the distance between the supporting surface 183 upon which the H assembly 101 rests and the tray assembly 103. The telescopic stanchion 102 comprises a first tube 121, a second tube 122, and a lock pin 123. The lock pin 123 is a readily and commercially available cotter pin. As shown most clearly in FIGS. 1, 2, and 3, the first tube 121 is a readily and commercially available first perforated square steel tube. The second tube 122 is a readily and commercially available second perforated square steel tube. The first tube 121 and the second tube 122 are selected such that the outer dimensions of the second tube 122 are lesser than the inner dimensions of the first tube 121 such that the second tube 122 will slide within the first tube 121. The first tube 121 is further defined with a first plurality of perforations, a seventh end 167 and an eighth end 168. The second tube 122 is further defined with a second plurality of perforations, a ninth end 169 and a tenth end 170.

The telescopic stanchion 102 is assembled by inserting the ninth end 169 of the second tube 122 into the eighth end 168 of the first tube 121. To secure the second tube 122 within the first tube 121, the first plurality of perforations are aligned with second plurality of perforations such that the lock pin 123 is inserted through a first hole selected from the first plurality of perforations and the corresponding second hole selected from the second plurality of perforations. To adjust the span of the telescopic stanchion 102 from the seventh end 167 to the tenth end 170, the lock pin 123 is removed, the position of the second plurality of holes is changed relative to the first plurality of holes and the lock pin 123 is reinserted.

The H assembly 101 is a cart that is used to roll the invention 100 over the supporting surface 183. The H assembly 101 comprises a first strut 111, a second strut 112, a third strut 113, and a plurality of wheels 114. The second strut 112 attaches the first strut 111 to the third strut 113. Each of the plurality of wheels 114 is individually attached to a strut selected from the group consisting of the first strut 111 or the third strut 113. The first strut 111 is further defined with a first end 161 and a second end 162. The second strut 112 is further defined with a third end 163 and a fourth end 164. The third strut 113 is further defined with a fifth end 165 and a sixth end 166.

The H assembly 101 is formed in an "H" pattern. As shown in FIG. 1, the H assembly 101 is assembled as described in this paragraph and the next paragraph. The first strut 111 is a rectangle block shaped structural element formed from a readily and commercially available first steel tube. The second strut 112 is a rectangle block shaped structural element formed from a readily and commercially available second steel tube. The third strut 113 is a rectangle block shaped structural element formed from a readily and commercially available third steel tube. The third end 163 of the second strut 112 is attached to the center of the first strut 111. The fourth end 164 of the second strut 112 is attached to the center of the third strut 113.

Each of the plurality of wheels 114 is a readily and commercially available caster. The use of a locking caster is preferred. The plurality of wheels 114 further comprises a first wheel 151, a second wheel 152, a third wheel 153, and a fourth wheel 154. The first wheel 151 is attached to the first end 161 of the first strut 111 such that the first wheel 151 projects away from the surface of the first strut 111 that is distal from the primary surface 131 in a direction away from the primary surface 131. The second wheel 152 is attached to the second end 162 of the first strut 111 such that the second wheel 152 projects away from the surface of the first strut 111 that is distal from the primary surface 131 in a direction away from the primary surface 131. The third wheel 153 is attached to the fifth end 165 of the third strut 113 such that the third wheel 153 projects away from the surface of the third strut 113 that is distal from the primary surface 131 in a direction away from the primary surface 131. The fourth wheel 154 is attached to the sixth end 166 of the third strut 113 such that the fourth wheel 154 projects away from the surface of the third strut 113 that is distal from the primary surface 131 in a direction away from the primary surface 131.

To assemble the invention 100, as shown in FIG. 1, the telescopic stanchion 102 attaches to the H assembly 101, by attaching the seventh end 167 of the first tube 121 to the center of the surface of the first strut 111 that is proximal to the primary surface 131. To attach the telescopic stanchion 102 to the tray assembly 103, the tenth end 170 of the second tube 122 attaches to the surface of the first strut 111 that is proximal to the H assembly 101.

To use the invention 100, the invention 100 is rolled into position and the span of the telescopic stanchion 102 from the seventh end 167 to the tenth end 170 is set as described elsewhere within this disclosure. The invention 100 is then used as a table.

In the first potential embodiment of the disclosure, the telescopic stanchion 102, the H assembly 101 and the one or more horizontal surfaces 130 are formed from metal. Welded steel is preferred. The remaining components are commercially available.

The following definitions were used in this disclosure:

AC: As used in this disclosure, AC is an acronym for alternating current.

AC/DC Converter: As used in this disclosure, an AC/DC converter is an electrical device that converts an AC voltage into a DC voltage. Method to design and build AC/DC converters are well known in the electrical arts.

Cable: As used in this disclosure, a cable is a collection of insulated wires covered by a protective casing that is used for transmitting electricity or telecommunication signals.

Caster: As used in this disclosure, a caster is a wheel that is mounted on a swivel that allows the wheel to adjust, or swivel, the direction of rotation of the wheel to the direction of motion desired for the wheel.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Correspond: As used in this disclosure, the term correspond means that a first object is in some manner linked to a second object in a one to one fashion.

Cotter Pin: As used in this disclosure, a cotter pin is a metal shaft that is used to hold two mechanical components together.

DC: As used in this disclosure, DC is an acronym for direct current.

Domestic Article: As used in this disclosure, a domestic article is an item or object: 1) that is commonly found within a household; or, 2) that is commonly carried by a person. Examples of domestic articles include, but are not limited to, keys and key fobs, personal data devices, glasses, remote controls, or personal storage items such as purses, briefcases, wallets, or cases.

Inner Dimension: As used in this disclosure, the term inner dimension describes the span from a first inside or interior surface of a container to a second inside or interior surface of a container. The term is used in much the same way that a plumber would refer to the inner diameter of a pipe.

Light: As used in this disclosure, a light is an electrical device that generates visible light to illuminate objects so they can be seen.

National Electric Grid: As used in this disclosure, the national electric grid is a synchronized and highly interconnected electrical network that distributes energy in the form of electric power from a plurality of generating stations to consumers of electricity.

NEMA 5-15 Electrical Socket: As used in this disclosure, the NEMA 5-15 electrical socket is a port designed to provide electric power drawn from the National Electric Grid. The NEMA 5-15 electrical socket is commonly used to deliver electrical power to electric devices in residential, office, and light industrial settings. The typical NEMA5-15 electrical socket comprises a plurality of electric ports from which electric power is drawn. The position of each of the plurality of electric ports is placed in a standardized position. The typical NEMA5-15 electrical socket further comprises a plate hole which is a standardized hole located in a standardized position within the NEMA 5-15 electrical socket that that is designed to receive a bolt that is used to attach a faceplate to the NEMA 5-15 electrical socket. The NEMA 5-15 electrical socket is also commonly referred to as an electrical outlet.

Negative Space: As used in this disclosure, negative space is a method of defining an object through the use of open or empty space as the definition of the object itself, or, through the use of open or empty space to describe the boundaries of an object.

Nested: As used in this disclosure, nested refers to a relationship between two or more objects contained within a collection wherein any first object selected from the collection either: 1) contains within it a second object selected from the collection; 2) is contained within a second object selected from the collection; or, 3) contains within it a second object selected from the collection and is contained within a third object selected from the collection.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Perimeter: As used in this disclosure, a perimeter is one or more curved or straight lines that bounds an enclosed area on a plane or surface. The perimeter of a circle is commonly referred to as a circumference.

Personal Data Device: As used in this disclosure, a personal data device is a handheld device that is used for managing personal information and communication. Examples of personal data device include, but are not limited to, cellular phones, tablets and smart phones.

Recline: As used in this disclosure, recline refers to a person who lie backwards with the back supported. A person in such a position is said to be in a reclined position. Alternative, recline may refer to a seat or chair wherein the back of the seat is in a sloped position such that a person sitting in the seat is in a reclined position. Such a seat or chair is often referred to as a reclining chair or a reclining seat.

Ridge: As used in this disclosure, a ridge is an elevated or raised portion of a structure.

Rim: As used in this disclosure, a rim is an outer edge or border that follows along the perimeter of an object.

Stanchion: As used in this disclosure, a stanchion refers to an upright pole, post, or support.

Switch: As used in this disclosure, a switch is an electrical device that starts and stops the flow of electricity through an electric circuit by completing or interrupting an electric circuit.

USB: As used in this disclosure, USB is an acronym for Universal Serial Bus, which is an industry standard that defines the cables, the connectors, the communication protocols and the distribution of power required for interconnections between electronic devices. The USB standard defines several connectors including, but not limited to, USB-A, USB-B, mini-USB, and micro USB connectors.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A bedside table comprising:

a tray assembly, a telescopic stanchion, and an H assembly;

wherein the H assembly attaches to the telescopic stanchion;

wherein the telescopic stanchion supports the tray assembly;

wherein the bedside table is adapted for use on a supporting surface;

wherein the bedside table rolls over the supporting surface;

wherein the bedside table is for use with a reclining surface;

wherein the bedside table is adapted for use in storing domestic articles;

wherein the bedside table is adapted for use with the national electric grid;

wherein the bedside table is adapted for use with electrically powered devices;

wherein the bedside table provides one or more horizontal surfaces for use from the reclining surface;

wherein the bedside table is adjustable in height;

wherein the bedside table provides lighting and electric power for use at the one or more horizontal surfaces;

wherein the tray assembly comprises the one or more horizontal surfaces, an electrical housing, and a personal housing;

wherein the electrical housing is mounted on the one or more horizontal surfaces;

wherein the personal housing is mounted on the electrical housing in a location that is distal from the one or more horizontal surfaces;

wherein the one or more horizontal surfaces further comprises a primary surface and a nested surface;

wherein the nested surface is contained within the primary surface;

wherein the nested surface is further defined with a distal edge that includes a lip that extends vertically with respect to the nested surface;

wherein the primary surface is a first rectangular plate that forms a flat horizontal surface while the bedside table is in use;

wherein the primary surface comprises a channel and a lip;

wherein the lip is a rim that forms the perimeter of a contained space on the surface of the primary surface that is distal from the reclining surface;

wherein the channel is a cavity formed within the first rectangular plate of the primary surface;

wherein the nested surface is a second rectangular plate that forms a flat horizontal surface while the bedside table is in use;

wherein the inner dimensions of the channel are greater than the outer dimensions of the nested surface;

wherein the nested surface is sized such that the nested surface will slide into the channel;

wherein the electrical housing is a cabinet that is mounted on the surface of the primary surface that is distal from the reclining surface;

wherein the electrical housing draws electric power from the national electric grid;

wherein the electrical housing converts and transfers this power into forms compatible for use by the electrically powered devices;

wherein the electrical housing comprises an AC/DC converter, one or more electrical sockets, and one or more power ports;

wherein each of the one or more electrical sockets are directly connected to the national electric grid;

wherein each of the one or more power ports are connected to the AC/DC converter;

wherein the AC/DC converter is connected to the national electric grid.

2. The bedside table according to claim 1 wherein the one or more electrical sockets are mounted on the electrical housing such that the each of the one or more electrical sockets are accessible externally from the electrical housing;

wherein the one or more power ports are mounted on the electrical housing such that the each of the one or more power ports are accessible externally from the electrical housing.

3. The bedside table according to claim 2 wherein the personal housing is a cabinet;

wherein the personal housing comprises a first drawer and a second drawer;

wherein the first drawer is positioned above the second drawer;

wherein the second drawer extends outwardly with respect to the first drawer such that the first drawer and the second drawer collectively form a step.

4. The bedside table according to claim 3
wherein the personal housing further comprises a lamp;
wherein the lamp is a light that illuminates the primary surface and the nested surface of the bedside table;
wherein the lamp is connected via a cable that transfers power from a power source;
wherein the lamp is controlled through the use of a switch that is placed in series between the lamp and said power source.

5. The bedside table according to claim 4
wherein the telescopic stanchion comprises a first tube, a second tube, and a lock pin;
wherein the lock pin is a cotter pin;
wherein the first tube is a first perforated square steel tube;
wherein the second tube is a second perforated square steel tube;
wherein the second tube will slides within the first tube.

6. The bedside table according to claim 5
wherein the first tube is further defined with a first plurality of perforations, a seventh end and an eighth end;
wherein the second tube is further defined with a second plurality of perforations, a ninth end and a tenth end;
wherein the ninth end of the second tube inserts into the eighth end of the first tube;
wherein the first plurality of perforations are aligned with second plurality of perforations such that the lock pin is inserted through a first hole selected from the first plurality of perforations and the corresponding second hole selected from the second plurality of perforations.

7. The bedside table according to claim 6 wherein the span of the telescopic stanchion from the seventh end to the tenth end, is adjusted by changing the position of the second plurality of holes relative to the first plurality of holes.

8. The bedside table according to claim 7
wherein the H assembly comprises a first strut, a second strut, a third strut, and a plurality of wheels;
wherein the second strut attaches the first strut to the third strut;
wherein the each of the plurality of wheels is individually attached to a strut selected from the group consisting of the first strut or the third strut;
wherein the first strut is further defined with a first end and a second end;
wherein the second strut is further defined with a third end and a fourth end;
wherein the third strut is further defined with a fifth end and a sixth end.

9. The bedside table according to claim 8
wherein the first strut is a first steel tube;
wherein the second strut is a second steel tube;
wherein the third strut is a third steel tube;
wherein the third end of the second strut is attached to the center of the first strut;
wherein the fourth end of the second strut is attached to the center of the third strut.

10. The bedside table according to claim 9
wherein each of the plurality of wheels is a caster;
wherein the plurality of wheels further comprises a first wheel, a second wheel, a third wheel, and a fourth wheel;
wherein the first wheel is attached to the first end of the first strut such that the first wheel projects away from the surface of the first strut that is distal from the primary surface in a direction away from the primary surface;
second wheel is attached to the second end of the first strut such that the second wheel projects away from the surface of the first strut that is distal from the primary surface in a direction away from the primary surface;
third wheel is attached to the fifth end of the third strut such that the third wheel projects away from the surface of the third strut that is distal from the primary surface in a direction away from the primary surface;
fourth wheel is attached to the sixth end of the third strut such that the fourth wheel projects away from the surface of the third strut that is distal from the primary surface in a direction away from the primary surface.

11. The bedside table according to claim 10 wherein the telescopic stanchion attaches to the H assembly by attaching the seventh end of the first tube to the center of the surface of the first strut that is proximal to the primary surface.

12. The bedside table according to claim 11 wherein the tenth end of the second tube attaches to the surface of the first strut that is proximal to the H assembly.

13. The bedside table according to claim 12 wherein at least one wheel selected from the plurality of wheels is a locking caster.

* * * * *